US011092323B2

(12) United States Patent
Hawk et al.

(10) Patent No.: US 11,092,323 B2
(45) **Date of Patent: *Aug. 17, 2021**

(54) SWITCH FOR FIREARM-MOUNTABLE LIGHT

(71) Applicant: Streamlight, Inc., Eagleville, PA (US)

(72) Inventors: Joshua D. Hawk, Limerick, PA (US); William D. Worman, Phoenixville, PA (US); Jonathan R. Sharrah, Phoenixville, PA (US)

(73) Assignee: Streamlight, Inc., Eagleville, PA (US)

( * ) Notice: Subject to any disclaimer, the term of this patent is extended or adjusted under 35 U.S.C. 154(b) by 19 days.

This patent is subject to a terminal disclaimer.

(21) Appl. No.: 15/930,985

(22) Filed: May 13, 2020

(65) Prior Publication Data

US 2020/0271306 A1 Aug. 27, 2020

Related U.S. Application Data

(63) Continuation of application No. 16/229,645, filed on Dec. 21, 2018, now Pat. No. 10,670,251.

(51) Int. Cl.

| | |
|---|---|
| ***F21V 23/04*** | (2006.01) |
| ***F21L 4/00*** | (2006.01) |
| ***F41G 11/00*** | (2006.01) |
| ***F41G 1/35*** | (2006.01) |

(52) U.S. Cl.

CPC ..... *F21V 23/0414* (2013.01); *F21L 4/005* (2013.01); *F41G 1/35* (2013.01); *F41G 11/001* (2013.01)

(58) Field of Classification Search

CPC .... H01H 13/70; H01H 13/7013; H01H 13/85; F41G 11/003; F41G 1/35

See application file for complete search history.

(56) References Cited

U.S. PATENT DOCUMENTS

| | | | | |
|---|---|---|---|---|
| 7,199,315 | B1 ‡ | 4/2007 | Sharrah | F41A 17/06 200/51 |
| 7,845,105 | B1 ‡ | 12/2010 | Cahill | F41C 23/16 200/86 R |
| 2014/0069790 | A1 * | 3/2014 | Ely | H01H 11/00 200/5 A |
| 2017/0064430 | A1 * | 3/2017 | Zheng | H01H 13/70 |

OTHER PUBLICATIONS

SUREFIRE, DSF-870 Ultra-High Two-Output-Mode LED WeaponLight for Remington 870 [online], [Retrieved on Oct. 2, 2018] Retrieved from the internet: <https://www.surefire.com/dsf-870-shotgun-forend.html>.‡

Hamehaber & Hamekasher, Switch Pad. [Image retrieved from the internet, at http://www.hamehaber.co.il/ptt, on Nov. 28, 2018] [Additional photos taken Nov. 28, 2018].‡

SUREFIRE, DSF-500/590 Ultra-High Two-Output-Mode LED WeaponLight for Mossberg 500 and 590 [online], [Retrieved on Oct. 2, 2018] Retrieved from the internet: <https://www.surefire.com/dsf-500-590-shotgun-forend.html>.‡

* cited by examiner

‡ imported from a related application

*Primary Examiner* — Joseph L Williams

(74) *Attorney, Agent, or Firm* — Quarles & Brady LLP; James J. Aquilina

(57) ABSTRACT

A firearm-mountable device having an improved switch assembly is shown and described.

20 Claims, 7 Drawing Sheets

SWITCH FOR FIREARM-MOUNTABLE LIGHT

CROSS-REFERENCE TO RELATED APPLICATION

The present application is a continuation of U.S. patent application Ser. No. 16/229,645, filed Dec. 21, 2018, which is incorporated herein by reference in its entirety.

FIELD OF THE DISCLOSURE

The present disclosure relates to the field of lighting devices, and more particularly to a firearm-mountable light having an improved switch assembly.

BACKGROUND

Firearm-mountable lights that include on-off switches are known in the art. Examples of these lights include the TLR series of lights manufactured and sold by Streamlight, Inc. of Eagleville, Pa., U.S.A., which is the applicant of the present application. Some of these switches are small and difficult to locate for users, especially in high-stress and/or low-visibility scenarios.

There is a need for improved firearm-mountable lighting devices that overcome these and other drawbacks present in the relevant prior art devices.

BRIEF DESCRIPTION OF THE DRAWINGS

The lighting device according to the present disclosure is further described with reference to the accompanying drawings, in which.

SUMMARY OF THE INVENTIVE CONCEPTS

Figure 1:
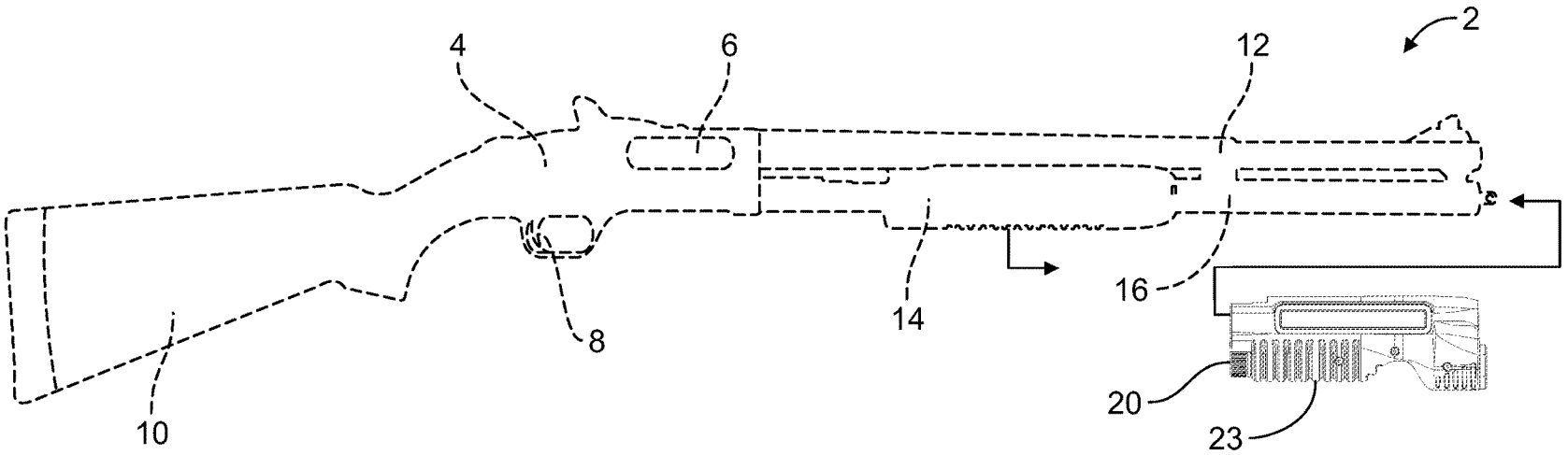
FIG. 1 is a side view of a firearm-mountable light according to the present disclosure, in an unmounted configuration with respect to an exemplary firearm as shown.

In one respect, the inventive concept is a switch assembly that is in electrical connection with at least one object, the switch assembly comprising: a first tactile switch, the first tactile switch having a first trip force rating, a first state when a first applied force that is applied to the first tactile switch has a value that is less than the first trip force rating, and a second state that results when the first applied force has a value that is equal to or in excess of the first trip force rating, a second tactile switch spaced apart from the first tactile switch, the second tactile switch having a second trip force rating, a first state when a second applied force that is applied to the second tactile switch has a value that is less than the second trip force rating, and a second state that results when the second applied force has a value that is equal to or in excess of the second trip force rating, a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply the first applied force to the first tactile switch and/or the second actuating button to apply the second applied force to the second tactile switch, and wherein if at least one of the first tactile switch or the second tactile switch is placed into its respective second state, an electrical signal is sent to the at least one object.

In another respect, the inventive concept is a switch assembly comprising: a first electrical contact; a second electrical contact, the first electrical contact and the second electrical contact being spaced apart; a first tactile switch located adjacent to the first electrical contact, the first tactile switch having a first trip force rating; a second tactile switch located adjacent to the second electrical contact, the second tactile switch having a second trip force rating; a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply a first applied force to the first tactile switch and the second actuating button to apply a second applied force to the second tactile switch, wherein if the first applied force has a value that is equal to or in excess of the first trip force rating, the first tactile switch deforms and makes contact with the first electrical contact, and wherein if the second applied force has a value that is equal to or in excess of the second trip force rating, the second tactile switch deforms and makes contact with the second electrical contact.

Further aspects of the disclosure include:

Aspect 1: A light adapted to be mountable to a firearm, the light comprising: a light assembly including at least one light source; a power source in electrical connection with the light assembly to supply power to the light assembly; and a switch assembly, the switch assembly comprising a first tactile switch, the first tactile switch having a first trip force rating, a first state when a first applied force that is applied to the first tactile switch has a value that is less than the first trip force rating, and a second state that results when the first applied force has a value that is equal to or in excess of the first trip force rating, a second tactile switch being spaced apart from the first tactile switch, the second tactile switch having a second trip force rating, a first state when a second applied force that is applied to the second tactile switch has a value that is less than the second trip force rating, and a second state that results when the second applied force has a value that is equal to or in excess of the second trip force rating, a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply the first applied force to the first tactile switch and/or the second actuating button to apply the second applied force to the second tactile switch, and wherein if at least one of the first tactile switch or the second tactile switch is placed into its respective second state, at least one state of the light assembly is adjusted.

Aspect 2: The light of Aspect 1, wherein the bar has a first hole into which the first actuating button at least partially fits and a second hole into which the second actuating button at least partially fits.

Aspect 3: The light of Aspect 1, wherein each of the first tactile switch and the second tactile switch has a body having a domed shape.

Aspect 4: The light of Aspect 3, wherein each of the first tactile switch and the second tactile switch has a dimple extending outwardly from the respective body thereof toward the bottom surface of the bar.

Aspect 5: The light of Aspect 1, wherein the at least one state of the light assembly that is adjusted when the first tactile switch or the second tactile switch is placed into its respective second state is an on/off state of the light assembly.

Aspect 6: The light of Aspect 1, the switch assembly further comprising a first electrical contact in electrical connection with the light assembly and the power source and a second electrical contact in electrical connection with the light assembly and the power source, the first tactile switch located adjacent to the first electrical contact and the second tactile switch located adjacent to the second electrical contact.

Aspect 7: The light of Aspect 6, wherein the first tactile switch is located directly adjacent to the first electrical contact and the second tactile switch is located directly adjacent to the second electrical contact.

Aspect 8: The light of Aspect 1, the switch assembly further comprising a boot comprised of a deformable material, the boot having a depressible portion, wherein the bar is at least partially supported within an interior side of the boot, wherein the depressing force is applied directly to the depressible portion of the boot.

Aspect 9: The light of Aspect 8, wherein the interior side of the boot has an opening and a plurality of ribs, the opening being sized to accommodate insertion of the bar therein, the plurality of ribs extending inwardly from the opening and thereby acting to maintain the bar within the opening.

Aspect 10: The light of Aspect 8, wherein the depressible portion of the boot has a curved shape.

Aspect 11: The light of Aspect 8, wherein the interior side of the boot has at least one rib protruding from a surface thereof, the at least one rib acting to direct the depressing force that is applied to the boot to the first actuating button and the second actuating button.

Aspect 12: The light of Aspect 1, the switch assembly further comprising: a third tactile switch, the third tactile switch having a third trip force rating, a first state when a third applied force that is applied to the third tactile switch has a value that is less than the third trip force rating, and a second state that results when the third applied force has a value that is equal to or in excess of the third trip force rating; and a third actuating button located at least partially between the bottom surface of the bar and the third tactile switch; wherein the application of the depressing force to the top surface of the bar anywhere along the length thereof causes the first actuating button to apply the first applied force to the first tactile switch and/or the second actuating button to apply the second applied force to the second tactile switch and/or the third actuating button to apply a third applied force to the third tactile switch, and wherein if the third tactile switch is placed into its second state, the at least one state of the light assembly is adjusted.

Aspect 13: The light of Aspect 12, wherein the bar has a third hole into which the third actuating button at least partially fits.

Aspect 14: A switch assembly that is adapted to be mountable to a firearm, the switch assembly comprising: a first electrical contact; a second electrical contact, the first electrical contact and the second electrical contact being spaced apart; a first tactile switch located adjacent to the first electrical contact, the first tactile switch having a first trip force rating; a second tactile switch located adjacent to the second electrical contact, the second tactile switch having a second trip force rating; a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply a first applied force to the first tactile switch and the second actuating button to apply a second applied force to the second tactile switch, wherein if the first applied force has a value that is equal to or in excess of the first trip force rating, the first tactile switch deforms and makes contact with the first electrical contact, and wherein if the second applied force has a value that is equal to or in excess of the second trip force rating, the second tactile switch deforms and makes contact with the second electrical contact.

Aspect 15: The switch assembly of Aspect 14, wherein the bar has a first hole into which the first actuating button at least partially fits and a second hole into which the second actuating button at least partially fits.

Aspect 16: The switch assembly of Aspect 14, wherein each of the first tactile switch and the second tactile switch has a body having a domed shape, wherein each of the first tactile switch and the second tactile switch has a dimple extending outwardly from the respective body thereof toward the bottom surface of the bar.

Aspect 17: The switch assembly of Aspect 14, wherein the first tactile switch is located directly adjacent to the first electrical contact and the second tactile switch is located directly adjacent to the second electrical contact.

Aspect 18: The switch assembly of Aspect 17, wherein the first electrical contact and the second electrical contact are located on a printed circuit board, the first tactile switch is at least partially adhered to the printed circuit board directly adjacent to the first electrical contact, and the second tactile switch is at least partially adhered to the printed circuit board directly adjacent to the second electrical contact.

Aspect 19: The switch assembly of Aspect 14, further comprising a boot comprised of a deformable material, the boot having a depressible portion, wherein the bar is at least partially supported within an interior side of the boot, wherein the depressing force is applied directly to the depressible portion of the boot.

Aspect 20: The switch assembly of Aspect 19, wherein the interior side of the boot has at least one rib protruding from a surface thereof, the at least one rib acting to direct the depressing force that is applied to the boot to the first actuating button and the second actuating button.

DETAILED DESCRIPTION

The ensuing detailed description provides exemplary embodiment(s) only, and is not intended to limit the scope, applicability, or configuration of the herein disclosed embodiment(s). Rather, the ensuing detailed description of the exemplary embodiment(s) will provide those skilled in the art with an enabling description for implementing the exemplary embodiments in accordance with the present disclosure. It should be understood that various changes may be made in the function and arrangement of elements without departing from the spirit and scope of the invention, as set forth in the appended claims.

To aid in describing the disclosure and/or invention as claimed, directional terms may be used in the specification and claims to describe portions of the present disclosure and/or invention (e.g., upper, lower, left, right, etc.). These directional definitions are merely intended to assist in describing the embodiment(s) and claiming the invention, and are not intended to limit the disclosure or claimed invention in any way. In addition, reference numerals that are introduced in the specification in association with a drawing figure may be repeated in one or more subsequent figures without additional description in the specification, in order to provide context for other features.

It should be understood that when an element is referred to as being "connected" or "coupled" to another element, it can be directly connected or coupled to the other element or that intervening elements may be present. In contrast, when an element is referred to as being "directly connected" or "directly coupled" to another element, it should be understood that no intervening elements are present. Other words used to describe the relationship between elements should be interpreted in a like fashion (e.g., "between" versus "directly between," "adjacent" versus "directly adjacent," etc.).

In embodiments described herein or shown in the drawings, any direct electrical connection or coupling, i.e., any connection or coupling without additional intervening elements, may also be implemented by an indirect connection or coupling, i.e., a connection or coupling with one or more additional intervening elements, or vice versa, as long as the general purpose of the connection or coupling, for example, to transmit a certain kind of signal or to transmit a certain kind of information, is essentially maintained. Features from different embodiments may be combined to form further embodiments. For example, variations or modifications described with respect to one of the embodiments may also be applicable to other embodiments, unless noted to the contrary.

In applications in which it is desirable or necessary to illuminate a scene while handling a firearm, a light may be mounted to the firearm so that the operator need not handle the firearm and light separately. Such firearm-mountable lights may be mounted to a rail, forend, barrel, or any other portion of the firearm. While holding a firearm, especially a long gun such as a rifle or shotgun, it may be difficult for a user to quickly locate and actuate the on/off and/or any adjustment switches that comprise the firearm-mountable light, especially in high-stress and/or low-visibility scenarios. It is the desire of Applicant to disclose a firearm-mountable light having one or more switches that improve upon the prior art.

Figure 2:
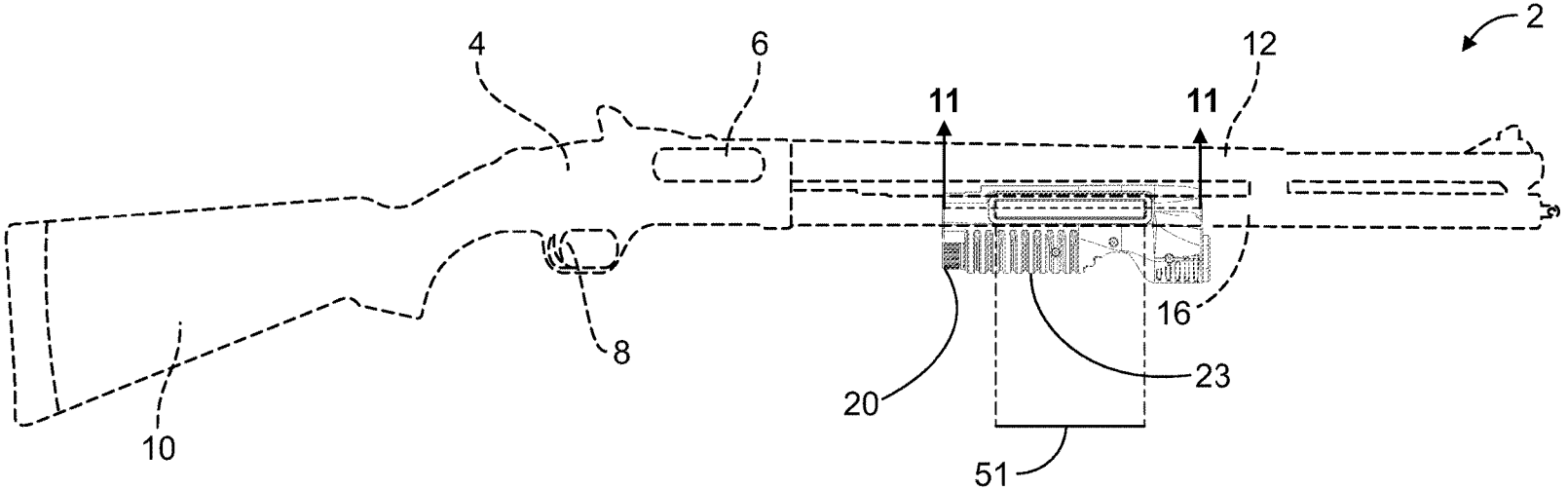
FIG. 2 is a side view thereof, with the firearm-mountable light in a mounted configuration with respect to the exemplary firearm.

Referring now generally to FIGS. 1-12, one embodiment of a firearm-mountable light 20 according to the present disclosure will be described in detail. FIGS. 1 and 2 show an exemplary long gun in phantom lines, in the form of a shotgun 2 having a receiver 4 that includes an ejection port 6, a trigger 8, a stock 10, a barrel 12, a forend 14, and a magazine tube 16 onto which the forend 14 is installed, as would be appreciated by a person having ordinary skill in the relevant art. FIG. 1 shows the light 20 according to the present disclosure in an unmounted configuration with respect to the shotgun 2, and FIG. 2 shows the light 20 mounted on the magazine tube 16 of the shotgun 2.

When a user is holding a typical long gun (e.g., shotgun 2), one hand is typically in the vicinity of the receiver 4 so that one or more fingers can access the trigger 8, and the other hand typically holds the forend 14 of the gun. In the example shown in FIGS. 1 and 2, the forend 14 of the shotgun 2 includes a grip portion to comfortably accommodate the user's forward-located hand. As shown in FIG. 2, the light 20 according to the present disclosure serves as a replacement for the stock forend 14, and includes both a grip portion 23 that serves as a replacement for the forend 14 and all functional components of a flashlight, as will be described in detail below. As will also be described in detail below, the light 20 may be easily activated by the user's forward-located hand, since this hand will already be in contact with the light 20. In this embodiment, the light 20 is held in place on the shotgun 2 using the same retaining ring (not shown) used to hold the stock forend 14 on the shotgun 2, as would be appreciated by a person having ordinary skill in the art. In this embodiment, the forend 14 is removed from the magazine tube 16 by loosening the stock retaining ring and then sliding the forend 14 forwardly in the direction shown in FIG. 1 until it has been removed from the magazine tube 16. The light 20 is then installed over the magazine tube 16 by sliding it onto the magazine tube 16 in the opposite direction, as also shown in FIG. 1.

Known firearm-mountable lights are not integral with a forend or other grip-containing portion of the firearm. Known firearm-mountable lights also typically have one or more small switches which may be difficult to locate with one's forward hand without looking at the side of the firearm, which would require the user to take their gaze off of a potential or intended target and possibly put them in harm's way or distract them from the target. Some prior art devices also have only a single switch, which in some case may be awkwardly placed for some users, specifically since single-switch placement may not be ideal for both right- and left-handed shooters and users having different hand/arm sizes. The light 20 according to the present disclosure addresses these issues in several ways. First, the light 20 includes a pair of switch assemblies 40, 50 located on opposite sides of the light 20 for redundancy, each of which is adapted to turn a light assembly 38 of the light 20 on and off. Second, the switch assemblies 40, 50 have extended lengths 43, 51 and specially-designed pressing mechanisms—as will be discussed below in greater detail—such that either switch assembly 40, 50 may be pressed—and the attached light assembly 38 thus activated—by pressing along any portion of the length 43, 51 of either of the switch assemblies 40, 50 with a depressing force sufficient to actuate the switch assembly 40, 50 (e.g., move the respective switch assembly from its open state to its closed state). It should be understood that an adequate depressing force will first have to compress the relevant portion of the respective boot 42, 54 of the switch assemblies 40, 50 before any portion of the depressing force can be transferred to the other components of the switch assemblies 40, 50, as will be discussed in further detail below. Third, the switch assemblies 40, 50 are located on the same housing 22 of the light 20 that includes the grip portion 23, thereby automatically placing the user's forward-located hand in the vicinity of the switch assemblies 40, 50 and ensuring that the user will not have difficulty locating either or both of the switch assemblies 40, 50.

Figure 4:
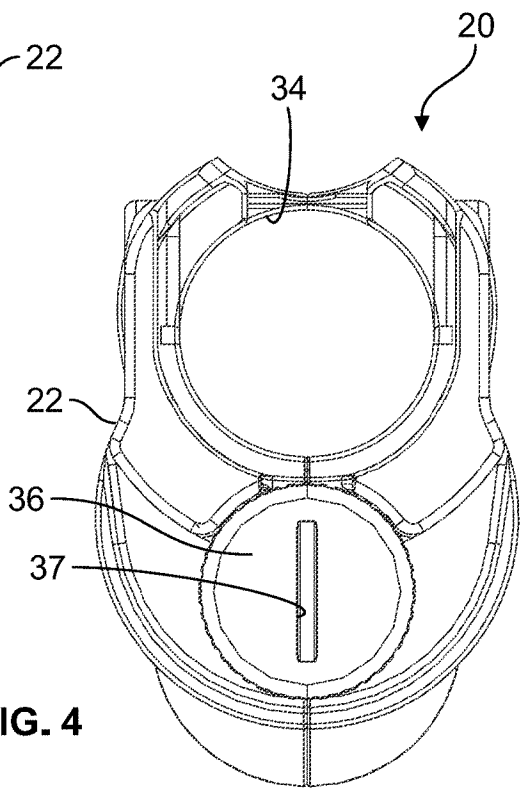
FIG. 4 is a rear view thereof.
Figure 3:
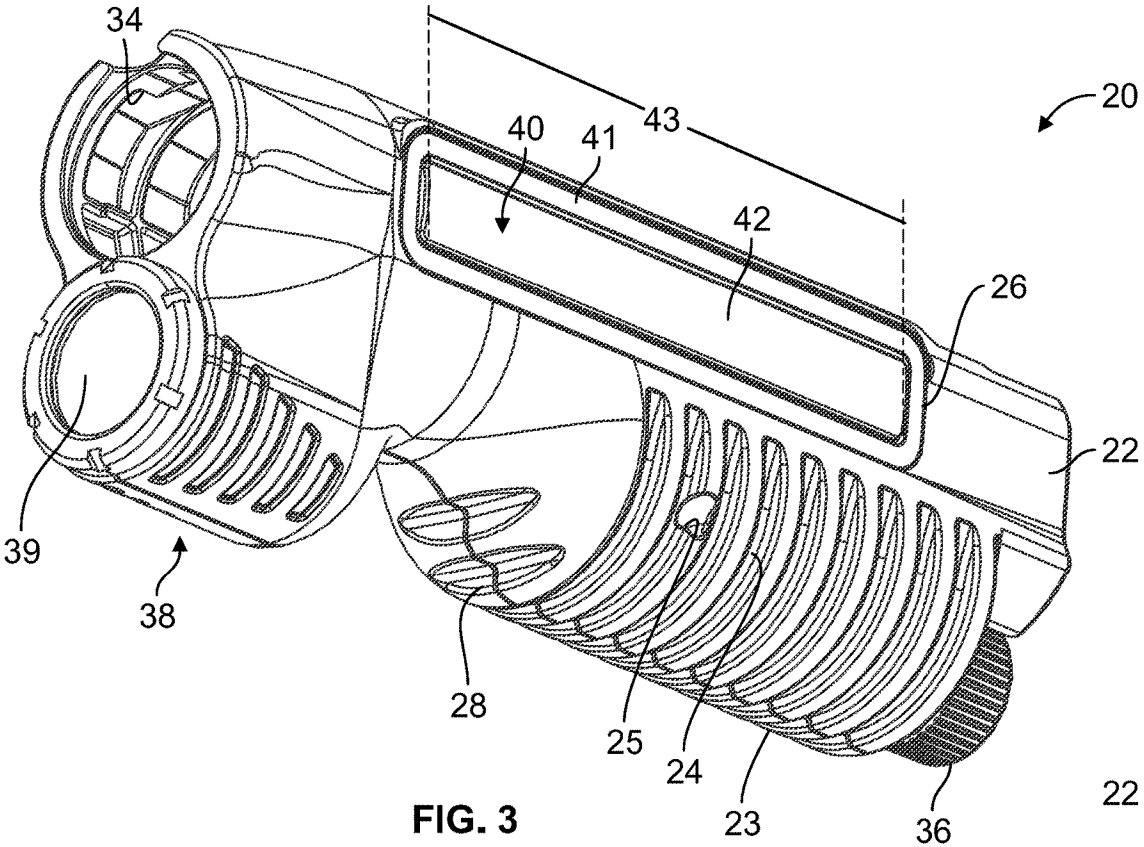
FIG. 3 is a perspective side view of the firearm-mountable light according to the present disclosure.

FIGS. 3 and 4 show the light 20 in its fully-assembled state. In this embodiment, the light 20 comprises a housing 22 that includes two housing halves 24, 28, the grip portion 23, a firearm-attachment portion 34 that is used to removably attach the light 20 to a portion of a firearm (e.g., magazine tube 16 of shotgun 2), the light assembly 38, and the switch assemblies 40, 50. In this embodiment, housing half 24 includes a fastener passage 25 and housing half 28 includes fastener passages 29, 30, 31 through which appropriate fasteners (e.g., machine screws; not shown) may be passed so that the housing halves 24, 28 are fixedly joined together.

The light assembly 38 comprises a lamp (not shown; for example one or more LEDs), a reflector (not shown), and a lens 39, as would be understood by one having ordinary skill in the art. The housing 22 further comprises a battery compartment (not labeled) in which one or more power sources (e.g., removable or rechargeable batteries) that power the light 20 are held. In this embodiment, the battery compartment is concealed by a cover 36, which in this embodiment includes a slot 37. In this embodiment, the slot 37 is indented within the cover 36 and sized and shaped such that a coin or flathead screwdriver can be inserted within the slot 37 and used to loosen from or tighten the cover 36 onto the battery compartment.

In the present embodiment, the firearm-attachment portion 34 of the light 20 is sized and shaped to fit a particular make and model of shotgun, specifically the Mossberg 500 and similar models. It should be understood that the light 20 according to the present disclosure could be modified to fit any type of firearm, for example different types of shotguns, rifles, other long arms, pistols, revolvers, or other sidearms, with the necessary size and shape changes having been made to the firearm-attachment portion 34 thereof to either custom fit a particular firearm mounting portion (e.g., a magazine tube, barrel, or other firearm component) or being equipped with adjustable fasteners, clips, spring-loaded clamps, or other means that allow the light 20 to be snugly attached to a range of firearms within a particular class or classes of firearm.

Turning back to the present embodiment, the housing half 24 of the housing 22 includes a switch recess 26 into which the switch assembly 40 is installed, and the housing half 28 of the housing 22 includes a switch recess 32 into which the switch assembly 50 is installed. In this embodiment, each of the switch assemblies 40, 50 is installed within its respective switch recess 26, 32 so that the outer portions of each switch assembly 40, 50 (i.e., weld plates 41, 52 and boots 42, 54) are flush with the outer surface of the respective housing half 24, 28, and the exterior sides of the boots 42, 54 of the respective switch assemblies 40, 50 each include a curved surface that conforms to the shape of the respective housing half 24, 28. As would be understood by a person having ordinary skill in the art, the switch assemblies 40, 50 are wired to the battery compartment as a power source and to the light assembly 38 so that the light assembly 38 can be turned on and off and/or otherwise adjusted (e.g., light intensity, light mode) via the switch assemblies 40, 50. The arrangement and functionality of the contents of the housing 22 are otherwise standard in the art, and will not be described further herein.

Figure 5:
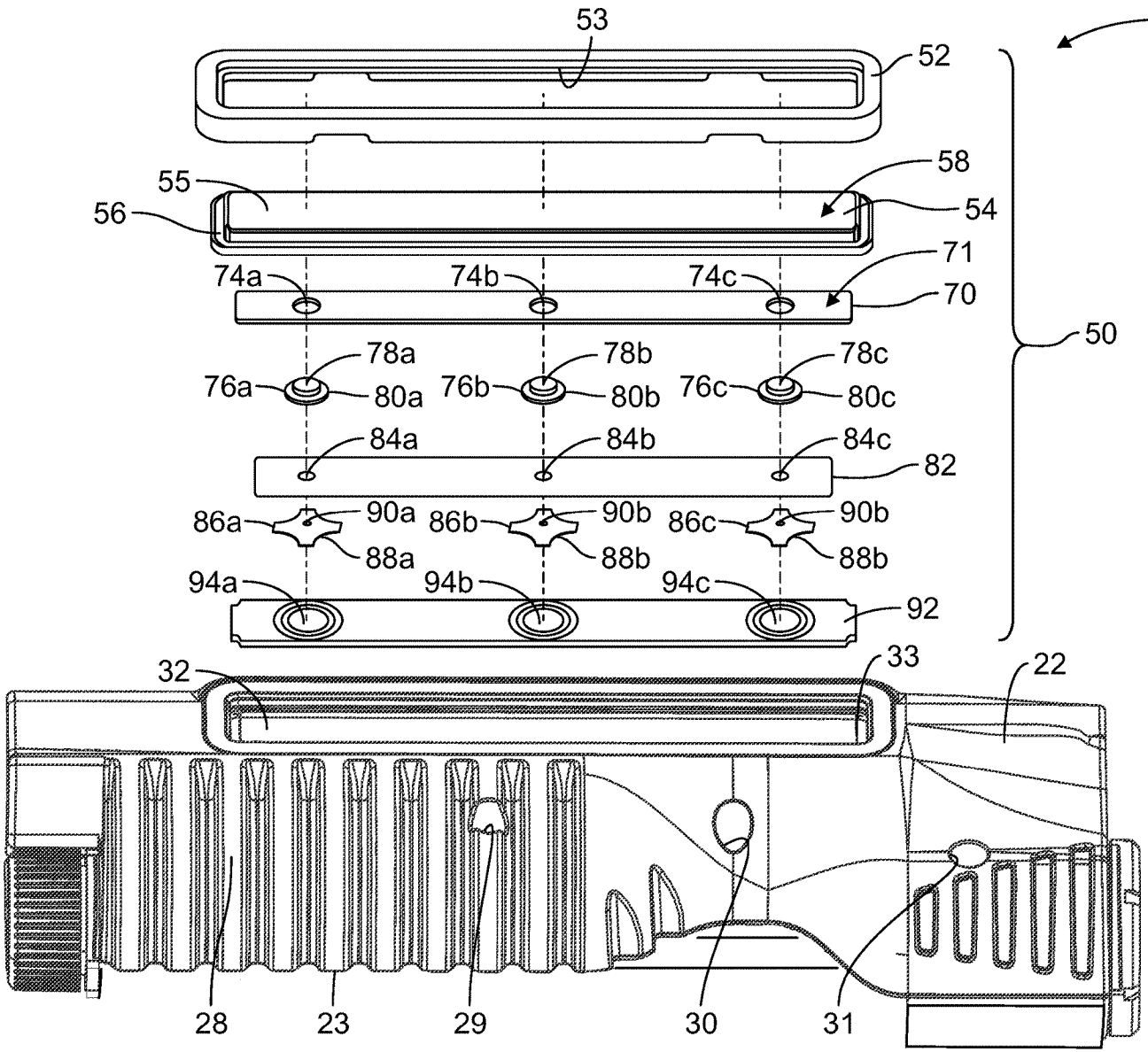
FIG. 5 is a partial exploded view of the firearm-mountable light, including an exploded view of a switch assembly thereof according to the present disclosure.
Figure 6:
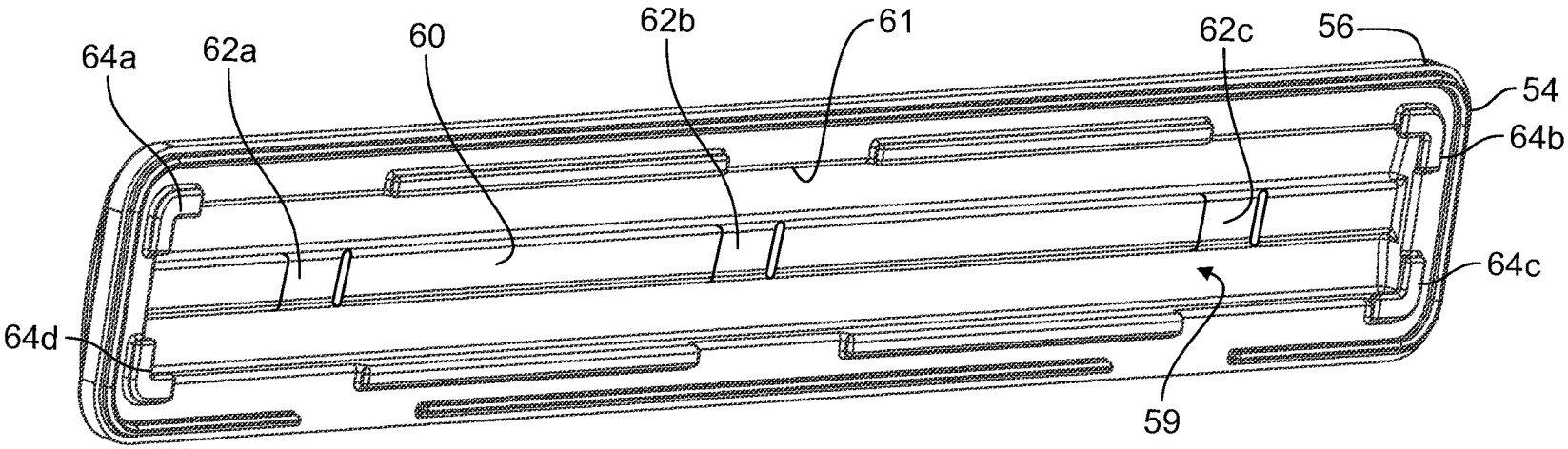
FIG. 6 is a view of the bottom side of a component of the switch assembly of FIG. 5.
Figure 7:
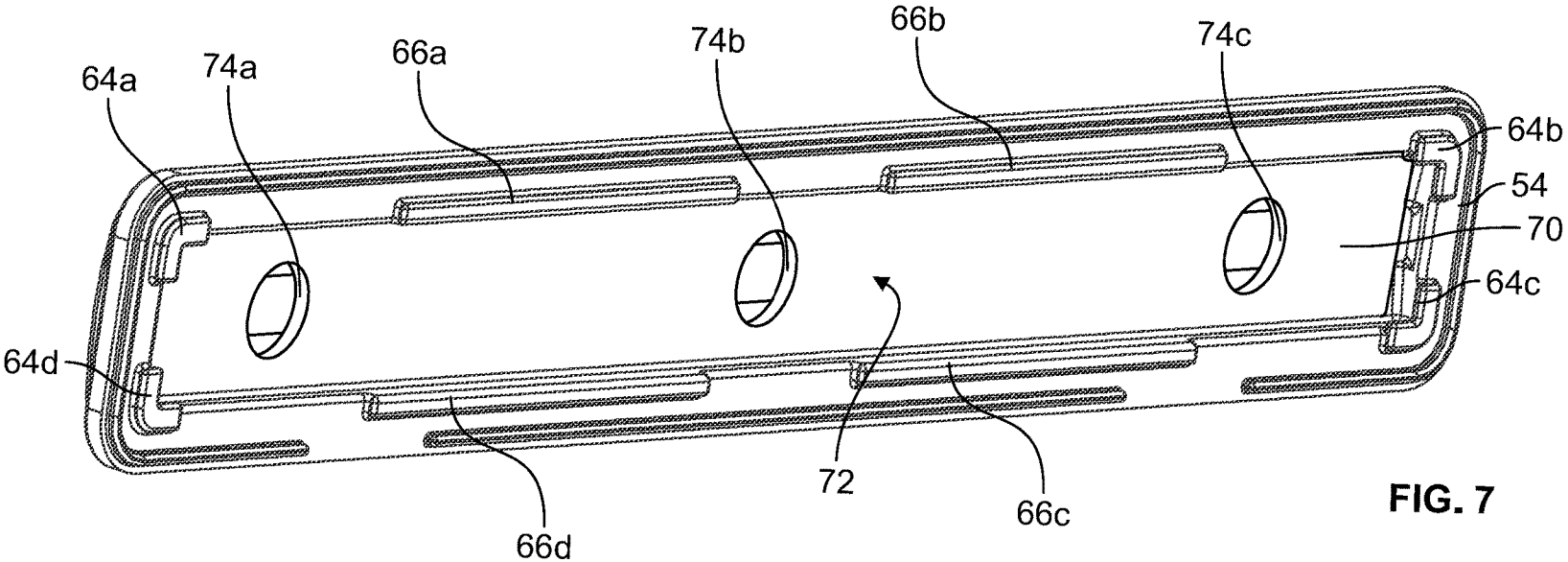
FIG. 7 is a view of the bottom sides of components of the switch assembly of FIG. 5.
Figure 8:
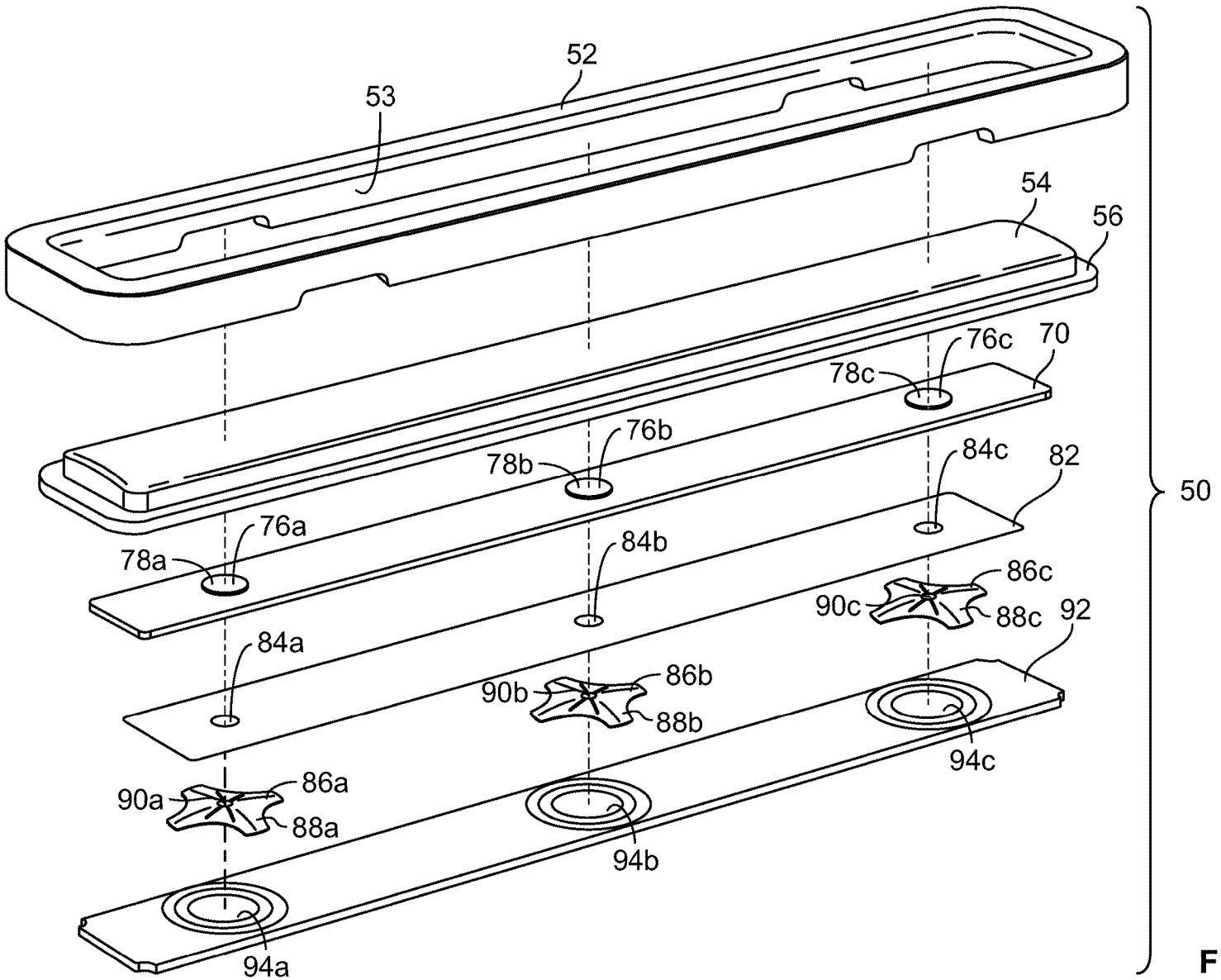
FIG. 8 is a partial exploded view of the switch assembly of FIG. 5.
Figure 9:
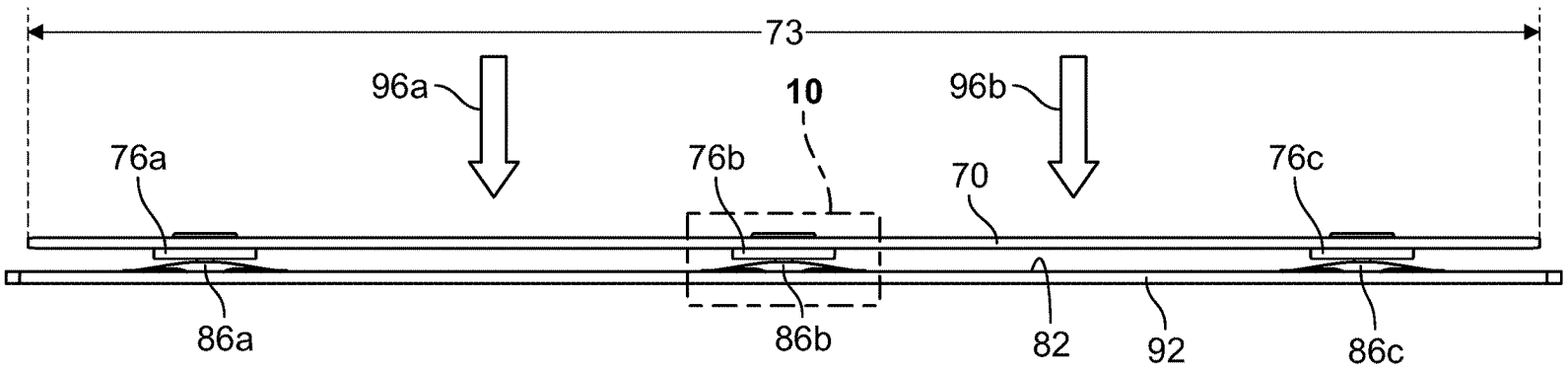
FIG. 9 is a side view of components of the switch assembly of FIG. 5.
Figure 10:
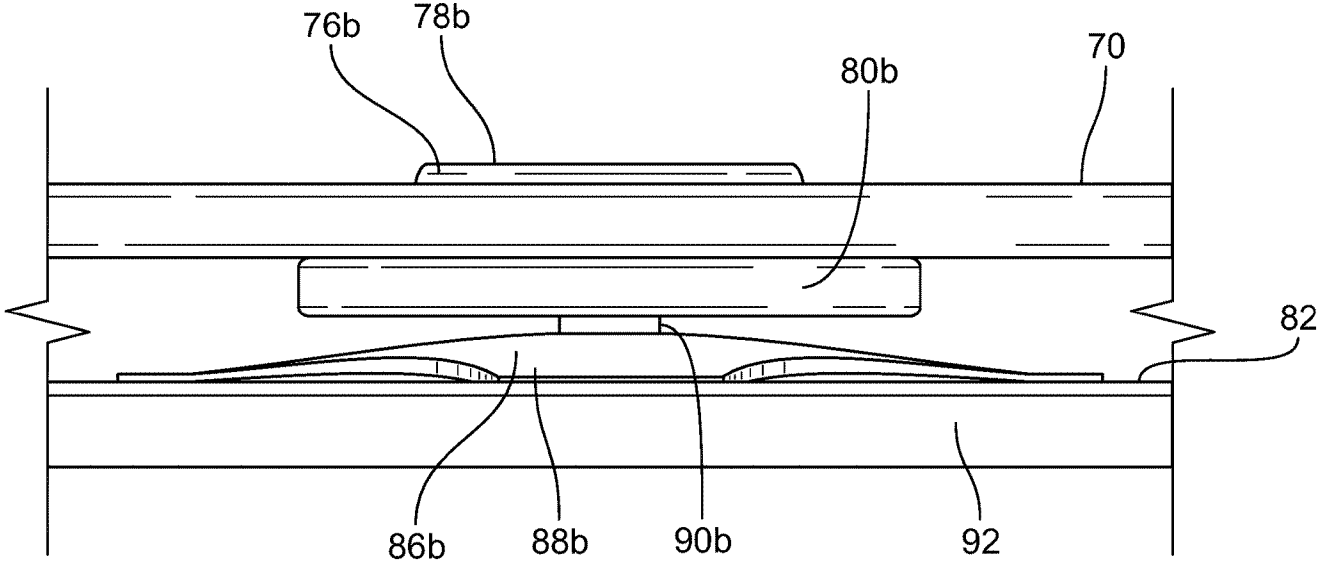
FIG. 10 is a close-up view of the area indicated by the box labeled "10" in FIG. 9.
Figure 11:
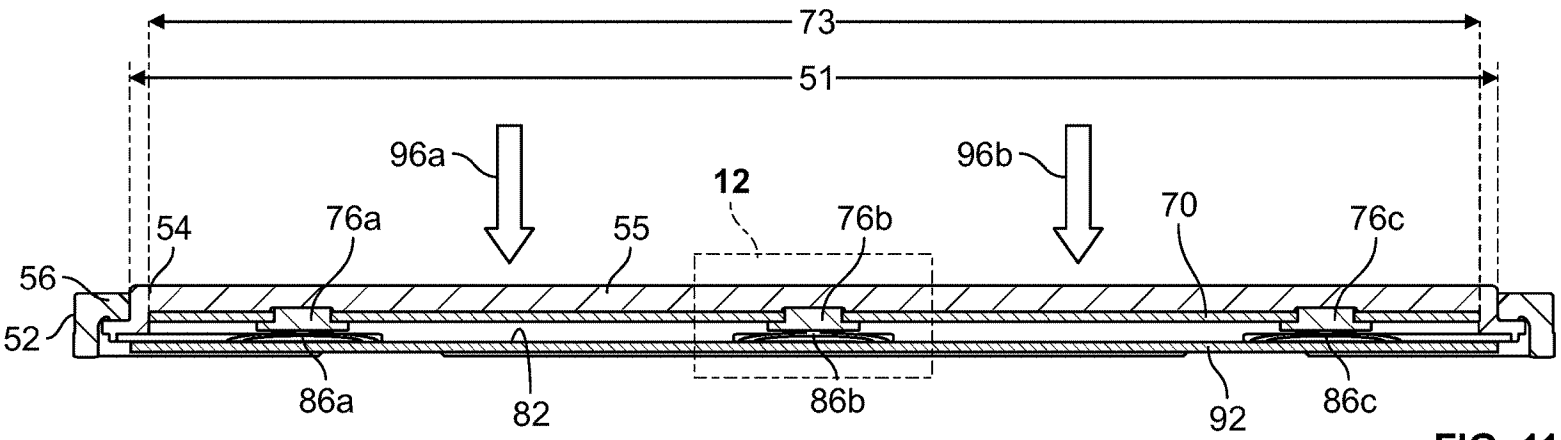
FIG. 11 is a sectional view of the switch assembly, taken along the line labeled "11-11" of FIG. 2, with the remainder of the firearm-mountable light removed from view.
Figure 12:
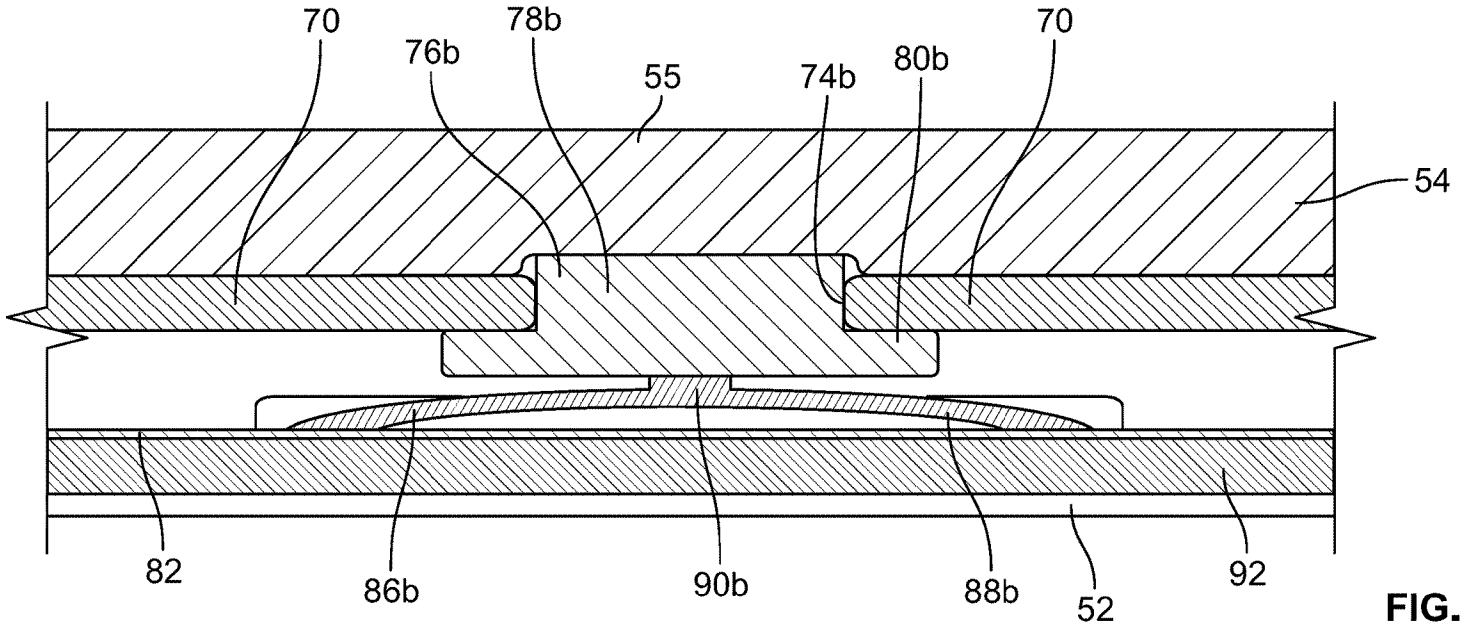
FIG. 12 is a close-up view of the area indicated by the box labeled "12" in FIG. 11.

FIGS. 5-8 show various components of the switch assembly 50, it being understood that switch assembly 40 is identical thereto and that all of the discussion herein specific to switch assembly 50 is equally applicable to switch assembly 40. FIG. 5 shows the switch assembly 50 fully exploded and located aligned above the switch recess 32 of the housing half 28 of the housing 22. FIG. 5 shows a weld rim 33 located within the switch recess 32. When the switch assembly 50 is fully assembled, a weld plate 52 of the switch assembly 50 secures a boot 54 thereof and the weld plate 52 is welded down to the weld rim 33 within the switch recess 32, to fully install the switch assembly 50 to the housing 22 of the light 20. A weld plate 41 of the switch assembly 40 secures a boot 42 thereof and the weld plate 41 is welded down to a corresponding weld rim (not shown) located within the switch recess 26, to fully install the switch assembly 40 to the housing 22 of the light 20.

In this embodiment, the weld plates 41, 52 are welded to the respective switch recess 26, 32 via ultrasonic welding. In alternate embodiments, it should be understood that any other suitable type of welding technique, an adhesive, one or more fasteners, or a pressure/snap-fit/tab-and-slot design could be used to secure one or both of the switch assemblies 40, 50 to the respective switch recess 26, 32 via an outer plate (e.g., weld plates).

Referring back to the Figures, in this embodiment the weld plate 52 includes an interior area 53 (i.e., corresponding with its interior perimeter) into which the boot 54 fits. The boot 54 comprises a depressible portion 55 that is visible and accessible within the interior area 53 and a rim portion 56 that is concealed underneath the rim of the weld plate 52 when the switch assembly 50 is fully assembled. The boot 54 further comprises an exterior side 58 that may be contacted by a user's hand when the user wants to actuate the switch assembly 50, and an interior side 59 including an opening 61. In this embodiment, the boot 54 is comprised of a rubber material. In alternate embodiments, the boot 54 could be comprised of any suitable depressible or deformable material.

In the present embodiment, the switch assembly 50 further comprises: a bar 70 having a top surface 71, a bottom surface 72, and three holes 74*a*, 74*b*, 74 routed therethrough; actuating buttons 76*a*, 76*b*, 76*c*, each of which has a respective portion 78*a*, 78*b*, 78*c* associated with its upper side and a respective portion 80*a*, 80*b*, 80*c* associated with its lower side; a strip of adhesive tape 82; tactile switches 86*a*, 86*b*, 86*c*; and a printed circuit board (PCB) 92 having contacts 94*a*, 94*b*, 94*c*. The PCB 92 is fitted within the switch recess 32 and the contacts 94*a*, 94*b*, 94*c* are electrically connected to the contacts/PCB of the switch assembly 40, the battery compartment (i.e., the power source), and the light assembly 38 of the light 20 through known methods and arrangements.

When the switch assembly 50 is fully assembled, the bar 70 is fitted within the opening 61 in the boot 54 (see FIG. 7) and snugly held in place by corner ribs 64*a*, 64*b*, 64*c*, 64*d* located at the four corners of the interior side 59 of the boot 54 that are sized and shaped to partially undercut (i.e., sit atop the bottom surface 72 of) the bar 70. In the present embodiment, the actuating buttons 76*a*, 76*b*, 76*c* are each installed partially within a respective hole 74*a*, 74*b*, 74*c* in the bar 70. Specifically, portion 78*a* of the actuating button

76*a* is press fit into and extends through the hole 74*a* in the bar 70 while portion 80*a* thereof rests against the bottom surface 72 of the bar 70, portion 78*b* of the actuating button 76*b* is press fit into and extends through the hole 74*b* in the bar 70 while portion 80*b* thereof rests against the bottom surface 72 of the bar 70, and portion 78*c* of the actuating button 76*c* is press fit into and extends through the hole 74*c* in the bar 70 while portion 80*c* thereof rests against the bottom surface 72 of the bar 70. In this embodiment, each of the portions 78*a*, 78*b*, 78*c* of the respective actuating button 76*a*, 76*b*, 76*c* extends partially beyond the top surface 71 of the bar 70 and sits within a respective cutout 62*a*, 62*b*, 62*c* located in a protruding rib 60 that extends from the interior side 59 of the boot 54. The protruding rib 60 functions to direct the depressing force that is applied to the boot 54 by the user toward an axial centerline of the bar 70 (as measured along its length 73), which in turn focuses said force to the actuating buttons 76*a*, 76*b*, 76*c* and consequently directly to the switches 86*a*, 86*b*, 86*c*. This arrangement increases the responsiveness and reliability of the switch assembly 50. The interior side 59 of the boot 54 further comprises ribs 66*a*, 66*b*, 66*c*, 66*d* extending outwardly therefrom, which act to space the boot 54, bar 70, and actuating buttons 76*a*, 76*b*, 76*c* away from the PCB 92.

In this embodiment, each of the switches 86*a*, 86*b*, 86*c* is of dome-type (e.g., having an at least partially-convex curved shape) and has a respective body 88*a*, 88*b*, 88*c* and a respective dimple 90*a*, 90*b*, 90*c* that protrudes outwardly from the respective body 88*a*, 88*b*, 88*c* (i.e., towards the respective portion 80*a*, 80*b*, 80*c* of the respective actuating button 76*a*, 76*b*, 76*c* when the switch assembly 50 is fully assembled). Switch 86*a* is aligned above and secured to contact 94*a* located on the PCB 92 via the strip of adhesive tape 82, switch 86*b* is aligned above and secured to contact 94*b* located on the PCB 92 via the strip of adhesive tape 82, and switch 86*c* is aligned above and secured to contact 94*c* located on the PCB 92 via the strip of adhesive tape 82. In this embodiment, the strip of adhesive tape 82 contains three holes 84*a*, 84*b*, 84*c*, each of which aligns with a respective dimple 90*a*, 90*b*, 90*c* of a respective switch 86*a*, 86*b*, 86*c* when the switch assembly 50 is fully assembled, so that the dimples 90*a*, 90*b*, 90*c* are not covered by the strip of adhesive tape 82 and the strip of adhesive tape 82 does not interfere with functioning of the dimples 90*a*, 90*b*, 90*c*. The strip of adhesive tape 82 acts to hold each of the switches 86*a*, 86*b*, 86*c* in place on a respective contact 94*a*, 94*b*, 94*c* of the PCB 92. Although, in the present embodiment, a single strip of adhesive tape 82 is used to hold all three switches 86*a*, 86*b*, 86*c* in place on the PCB 92, in alternate embodiments separate pieces of adhesive tape could be used instead, and/or the holes 84*a*, 84*b*, 84*c* for the dimples 90*a*, 90*b*, 90*c* of the switches 86*a*, 86*b*, 86*c* could be omitted entirely.

Turning back to the present embodiment, the switches 86*a*, 86*b*, 86*c* are spaced apart on the PCB 92, with approximately 1.50 inches (3.81 cm) between each switch and approximately 0.50 inches (1.27 cm) of space left on either side of the end switches 86*a*, 86*c*, so that the switch assembly 50 of the present embodiment has a length 51—as measured between the edges of the boot 54—of approximately 4.00 inches (10.16 cm). This extended switch length allows for the user to easily locate and actuate the switch assembly 50 without looking therefor, which is especially helpful in low-light or other vision-impaired environments in which the switch assembly 50 may be difficult to see or where the quickest possible reaction time is desirable. In alternate embodiments, additional switches of even greater extended length are possible in view of the present disclosure, and if necessary to ensure proper functionality could employ multiple depressible boots/bars along their length.

The switches 86*a*, 86*b*, 86*c* in the present embodiment are TC series tactile dome switches made by Snaptron Inc. of Windsor, Colo., U.S.A. In this embodiment, each of the switches 86*a*, 86*b*, 86 has a reverse (i.e., protruding) dimple 90*a*, 90*b*, 90*c* on the top of the respective body 88*a*, 88*b*, 88*c* that serves as a built-in actuator, and each switch 86*a*, 86*b*, 86*c* has a trip (i.e., actuation) force of 340 g. In other words, each of the switches 86*a*, 86*b*, 86*c* will trip such that its respective body 88*a*, 88*b*, 88*c* will deform and come into contact with a respective contact 94*a*, 94*b*, 94*c* on the PCB 92 when subjected to a minimum of 340 g of a respective applied force that is applied by each of the actuating buttons 76*a*, 76*b*, 76*c* to the respective switch 86*a*, 86*b*, 86*c*. In the present embodiment, when any one of the contacts 94*a*, 94*b*, 94*c* is contacted by a respective switch 86*a*, 86*b*, 86*c* (i.e., any of the switches 86*a*, 86*b*, 86*c* is moved, the light assembly 38 of the light 20 is activated. In one respect, each applied force could be measured along a force vector parallel to depression directions 96*a*, 96*b*. In another respect, each applied force could be measured according to a recognized test standard for tactile switches, for example ASTM Test Method No. 2592, entitled Standard Test Method for Measuring the Force-Displacement of a Membrane Switch, the entire contents of which are incorporated herein by reference.

In alternate embodiments, two tactile switches or more than three tactile switches can be used in the switch assembly 50, with the bar 70 or other pressing mechanism appropriately located atop and spanning across the switches such that the application of a suitable amount of a depressing force anywhere along the length 51 of the switch assembly 50 causes the bar 70 to transfer an amount of force to at least one of the switches sufficient to actuate the light assembly 38, either with or without the use of intermediate actuating buttons used to focus the depressing force to the switches. In alternate embodiments, the switches could be altered or selected to trip at any particular quantity of trip force, and individual tactile switches used within a single switch assembly 50 need not have identical trip force ratings. For example, one or more switches located closer to the center of the length 51 of the switch assembly 50 could have a higher trip force rating than one or more switches placed near the ends of the length 51 of the switch assembly 50, to reflect that it may generally be easier for a user to impart higher forces along the center portion of the length 51 of the switch assembly 50 as compared to the ends thereof. In further alternate embodiments, the switches could be of any pressure-sensitive type, for example any type of known or hereafter-developed mechanical switch, pressure pad, pressure plate, or other pressure-sensitive type of switch capable of being changed between a first state and a second state or capable of sending an appropriate signal when an applied force of threshold value has been received.

Activation of the light assembly 38 involves changing at least one state thereof, including but not limited to an on/off state, light mode (e.g., solid, flashing, strobing), light intensity (e.g., low, medium, high), light color, and/or light beam shape (e.g., spot/flood). Different combination of switch assembly taps or timed depressions could be used in various embodiments according to the present disclosure to alter the various states of the light assembly 38.

In the present embodiment, the switch assemblies 40, 50 are redundant in that they are both designed to change the on/off state of the light assembly 38 of the light 20, for ease of either right-hand-forward or left-hand-forward use. In alternate embodiments, the switch assemblies 40, 50 could be designed to perform different functions with respect to states of the light assembly 38, e.g., with respect to changes to mode, intensity, color, and/or light beam shape, as would be appreciated by a person having ordinary skill in the art.

Although exemplary implementations of the herein described systems and methods have been described in detail above, those skilled in the art will readily appreciate that many additional modifications are possible in the exemplary embodiments without materially departing from the novel teachings and advantages of the herein described systems and methods. Accordingly, these and all such modifications are intended to be included within the scope of the herein described systems and methods. The herein described systems and methods may be better defined by the following exemplary claims.

What is claimed is:

1. A switch assembly that is in electrical connection with at least one object, the switch assembly comprising:

a first tactile switch, the first tactile switch having a first trip force rating, a first state when a first applied force that is applied to the first tactile switch has a value that is less than the first trip force rating, and a second state that results when the first applied force has a value that is equal to or in excess of the first trip force rating, a second tactile switch spaced apart from the first tactile switch, the second tactile switch having a second trip force rating, a first state when a second applied force that is applied to the second tactile switch has a value that is less than the second trip force rating, and a second state that results when the second applied force has a value that is equal to or in excess of the second trip force rating, a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply the first applied force to the first tactile switch and/or the second actuating button to apply the second applied force to the second tactile switch, and wherein if at least one of the first tactile switch or the second tactile switch is placed into its respective second state, an electrical signal is sent to the at least one object.

2. The switch assembly of claim 1, wherein the at least one object is a light assembly including at least one light source.

3. The switch assembly of claim 1, wherein the bar has a first hole into which the first actuating button at least partially fits and a second hole into which the second actuating button at least partially fits.

4. The switch assembly of claim 1, wherein each of the first tactile switch and the second tactile switch has a body having a domed shape.

5. The switch assembly of claim 4, wherein each of the first tactile switch and the second tactile switch has a dimple extending outwardly from the respective body thereof toward the bottom surface of the bar.

6. The switch assembly of claim 1, further comprising a first electrical contact in electrical connection with the at least one object and a second electrical contact in electrical connection with the at least one object, the first tactile switch located adjacent to the first electrical contact and the second tactile switch located adjacent to the second electrical contact.

7. The switch assembly of claim 6, wherein the first tactile switch is located directly adjacent to the first electrical contact and the second tactile switch is located directly adjacent to the second electrical contact.

8. The switch assembly of claim 1, further comprising a boot comprised of a deformable material, the boot having a depressible portion, wherein the bar is at least partially supported within an interior side of the boot, wherein the depressing force is applicable directly to the depressible portion of the boot.

9. The switch assembly of claim 8, wherein the interior side of the boot has an opening and a plurality of ribs, the opening being sized to accommodate insertion of the bar therein, the plurality of ribs extending inwardly from the opening and thereby acting to maintain the bar within the opening.

10. The switch assembly of claim 8, wherein the depressible portion of the boot has a curved shape.

11. The switch assembly of claim 8, wherein the interior side of the boot has at least one rib protruding from a surface thereof, the at least one rib acting to direct the depressing force that is applied to the boot to the first actuating button and the second actuating button.

12. The switch assembly of claim 1, further comprising:

a third tactile switch, the third tactile switch having a third trip force rating, a first state when a third applied force that is applied to the third tactile switch has a value that is less than the third trip force rating, and a second state that results when the third applied force has a value that is equal to or in excess of the third trip force rating; and a third actuating button located at least partially between the bottom surface of the bar and the third tactile switch;

wherein the application of the depressing force to the top surface of the bar anywhere along the length thereof causes the first actuating button to apply the first applied force to the first tactile switch and/or the second actuating button to apply the second applied force to the second tactile switch and/or the third actuating button to apply a third applied force to the third tactile switch, and wherein if the third tactile switch is placed into its second state, an electrical signal is sent to the at least one object.

13. The switch assembly of claim 12, wherein the bar has a third hole into which the third actuating button at least partially fits.

14. A switch assembly comprising:

a first electrical contact;

a second electrical contact, the first electrical contact and the second electrical contact being spaced apart;

a first tactile switch located adjacent to the first electrical contact, the first tactile switch having a first trip force rating;

a second tactile switch located adjacent to the second electrical contact, the second tactile switch having a second trip force rating;

a bar, the bar having a length, a top surface, and a bottom surface, a first actuating button located at least partially between the bottom surface of the bar and the first tactile switch, and a second actuating button located at least partially between the bottom surface of the bar and the second tactile switch, wherein the application of a depressing force to the top surface of the bar anywhere along the length thereof causes the first actuating button to apply a first applied force to the first tactile switch and the second actuating button to apply a second applied force to the second tactile switch, wherein if the first applied force has a value that is equal to or in excess of the first trip force rating, the first tactile switch deforms and makes contact with the first electrical contact, and wherein if the second applied force has a value that is equal to or in excess of the second trip force rating, the second tactile switch deforms and makes contact with the second electrical contact.

15. The switch assembly of claim 14, wherein the bar has a first hole into which the first actuating button at least partially fits and a second hole into which the second actuating button at least partially fits.

16. The switch assembly of claim 14, wherein each of the first tactile switch and the second tactile switch has a body having a domed shape, wherein each of the first tactile switch and the second tactile switch has a dimple extending outwardly from the respective body thereof toward the bottom surface of the bar.

17. The switch assembly of claim 14, wherein the first tactile switch is located directly adjacent to the first electrical contact and the second tactile switch is located directly adjacent to the second electrical contact.

18. The switch assembly of claim 17, wherein the first electrical contact and the second electrical contact are located on a printed circuit board, the first tactile switch is at least partially adhered to the printed circuit board directly adjacent to the first electrical contact, and the second tactile switch is at least partially adhered to the printed circuit board directly adjacent to the second electrical contact.

19. The switch assembly of claim 14, further comprising a boot comprised of a deformable material, the boot having a depressible portion, wherein the bar is at least partially supported within an interior side of the boot, wherein the depressing force is applied directly to the depressible portion of the boot.

20. The switch assembly of claim 19, wherein the interior side of the boot has at least one rib protruding from a surface thereof, the at least one rib acting to direct the depressing force that is applied to the boot to the first actuating button and the second actuating button.

* * * * *